US006470604B1

(12) United States Patent
Foster et al.

(10) Patent No.: US 6,470,604 B1
(45) Date of Patent: Oct. 29, 2002

(54) SNOWPLOW ATTACHMENT FOR PUSHING AND PULLING SNOW UP CLOSE TO BUILDINGS OR OTHER PERMANENT STRUCTURES

(75) Inventors: Gerald T. Foster, Shabbona Grove, IL (US); Paul Burton, Lee, IL (US); Robert W. Norton, Rockford, IL (US)

(73) Assignee: Farmers' Factory Company, Lee, IL (US)

( * ) Notice: Subject to any disclaimer, the term of this patent is extended or adjusted under 35 U.S.C. 154(b) by 0 days.

(21) Appl. No.: 09/620,168

(22) Filed: Jul. 20, 2000

(51) Int. Cl.[7] ..... E01H 5/04
(52) U.S. Cl. ..... 37/267; 37/274; 37/406
(58) Field of Search ..... 37/266, 268, 274, 37/281, 241, 267, 234, 406, 409, 410; 172/784, 785, 787

(56) References Cited

U.S. PATENT DOCUMENTS

| | | | | |
|---|---|---|---|---|
| 58,124 A | | 9/1866 | Nevens | |
| 1,020,727 A | | 3/1912 | Sutcliffe | |
| 2,086,430 A | * | 7/1937 | Parkes | 172/787 |
| 3,302,317 A | | 2/1967 | Domres | 37/179 |
| 3,483,643 A | | 12/1969 | Wenzel | 37/53 |
| 3,670,508 A | | 6/1972 | Engler | 61/63 |
| 3,794,195 A | | 2/1974 | Clevenger et al. | 214/145 |
| 3,800,447 A | | 4/1974 | Harvey | 37/41 |
| 3,807,065 A | | 4/1974 | Billingsley | 37/42 R |
| 4,008,771 A | | 2/1977 | Tomio | 172/806 |
| 4,261,115 A | | 4/1981 | Chittenden | 37/42 VL |
| 4,430,022 A | | 2/1984 | Kinnan | 405/183 |
| 4,506,465 A | * | 3/1985 | Johnson | 37/268 |
| 4,707,936 A | * | 11/1987 | Steinhoff | 37/264 |
| 4,907,357 A | | 3/1990 | Lilienthal | 37/197 |
| 5,046,271 A | | 9/1991 | Daniels | 37/231 |
| 5,058,295 A | * | 10/1991 | Holland | 37/268 |
| 5,098,252 A | | 3/1992 | Sheesley et al. | 414/723 |
| 5,265,355 A | | 11/1993 | Daniels | 37/231 |
| 5,392,538 A | | 2/1995 | Geerligs et al. | 37/268 |
| 5,595,007 A | * | 1/1997 | Biance | 37/268 |
| 5,724,755 A | | 3/1998 | Weagley | 37/233 |
| 6,314,666 B1 | | 11/2001 | Klemenhagen et al. | |

OTHER PUBLICATIONS

Hiniker C–Plow Broucher, Apr. 2000.*
Web page, Hiniker Company—*C–Plow Features*, http://www.hinikerco.com/cfeatur.html—2 pages, Sep. 29, 2000.
*Snow Business*, Sep., 2000, Hiniker C–Plow.

* cited by examiner

*Primary Examiner*—Thomas B. Will
*Assistant Examiner*—Meredith Petravick
(74) *Attorney, Agent, or Firm*—Leydig, Voit & Mayer, Ltd.

(57) ABSTRACT

A snowplow attachment for mounting to the front end of a vehicle that includes both a push blade operable during forward movement of vehicle and a pull blade operable during reverse movement of the vehicle. The pull blade drops down in front of the push blade such that pushed snow can then be pulled back. The snowplow can get up close to permanent structures such as buildings and remove snow therefrom. During the push mode, the pull blade is raised to avoid interference with pushed snow. The snowplow can include side plates located on the ends of the blades for containing the snow and prevent snow from escaping out the sides, thereby increasing the volume of snow moved by the plow during one sweep. According to one embodiment, the snowplow includes a push blade assembly that is adapted to mount directly on the vehicle and a movable pull blade carried by the push blade assembly. According to another embodiment, separate push blades and pull blades are arranged at separate locations on the attachment such that the entire attachment pivots to alternatively locate one of the blades close to the ground for selecting between pushing or pulling modes.

32 Claims, 7 Drawing Sheets

SNOWPLOW ATTACHMENT FOR PUSHING AND PULLING SNOW UP CLOSE TO BUILDINGS OR OTHER PERMANENT STRUCTURES

FIELD OF THE INVENTION

The present invention relates generally to snowplow apparatus, and more particularly to commercial snowplow attachments for vehicles such as trucks, tractors or skid steers and any loader mounted vehicle.

BACKGROUND OF THE INVENTION

Snowplows are well known apparatus for clearing snow from ground surfaces such as roadways, driveways, parking lots or other areas as desired. Snowplows are typically mounted on a vehicle and are either pushed or pulled to remove snow. For example, U.S. Pat. Nos. 5,392,538 and 4,907,357 disclose snow removal trucks having two separate snowplows including one plow on the front for pushing snow and second plow on the rear end for pulling snow. The provision of two separate snowplows on a truck is undesirable for a variety of reasons, including the extra expense necessary for providing and maintaining the plows and for practical reasons in that an operator cannot keep his eye on both plows at the same time which is potentially hazardous. U.S. Pat. No. 5,724,755 discloses a snow pusher that attaches to the bucket of a skid steer loader. Each of these aforementioned patents demonstrate that the highly desirable provision of side plates arranged on the opposite ends of a snowplow for increasing the volume of snow engaged by the snowplow. In particular, the side plates serve the function of containing the snow therebetween in front of the blade such that the snow continues to be engaged by the snowplow and does not escape out the sides.

One problem with these and other snowplows is that they are unable to easily get up close to permanent structures such as buildings for snow removal. For example, once snow is pushed up close to a building or other structure it is often very difficult if not impossible to remove that pushed snow other than manually or with another snow removal device. Moreover, the side plates increase the difficulty of locating the blade close to permanent structures and removing snow close to permanent structures.

SUMMARY OF THE INVENTION

It is an objective of the present invention to provide a snowplow apparatus that more effectively or more efficiently removes snow.

In that regard, it is a further objective to provide a snowplow apparatus that is able to more effectively remove snow next to permanent structures while retaining the ability to move a high volume of snow if so desired.

In accordance with these and other objectives, the present invention is directed towards a snowplow attachment for mounting to the front end of a vehicle such as a truck or skid steer or front end loaders of any kind that includes both a push blade (operable during forward movement of the vehicle) and a pull blade (operable during reverse movement of the vehicle). Importantly, the pull blade drops down in front of the push blade such that snow can easily be pulled back. It is an advantage that the snowplow can easily get up close to permanent structures such as buildings and remove snow therefrom even after pushing snow up close to the permanent structure. During the push mode, the pull blade is raised to avoid interference with pushed snow. The snowplow can include the desirable side plates located on the ends of the blades for containing the snow and prevent snow from escaping out the sides, thereby increasing the volume of snow moved by the plow during one sweep.

According to one embodiment of the present invention, the snowplow includes a push blade assembly that is adapted to mount directly on the vehicle and a vertically movable pull blade carried by the push blade assembly. The pull blade is maintained in a raised position during the push mode but is lowered when it is desired to go into pull mode and reverse the direction of the vehicle. The pull blade may be raised or lowered manually or by an actuator such as a fluid powered cylinder or electrical actuator such as a ball screw.

According to another embodiment of the invention, separate push blades and pull blades are arranged at separate generally fixed locations on the attachment such that the entire attachment pivots to alternatively locate one of the blades close to the ground for selecting between pushing or pulling modes. In this embodiment the pull blade similarly drops down in front of the push blade such that previously pushed snow can be pulled back. This embodiment can utilize the existing hydraulic pump of a skid steer or other loader tractors to switch between pushing and pulling modes, or can be mounted on a separate frame and pivoted by an additional actuator between pushing and pulling modes. This type of snowplow can have an attach mechanism on its back such as a quick attach mechanism common to skid steer loaders or pin on connections/attachments that are common to more conventional loader tractors.

Other objects and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENTS

Figure 1:
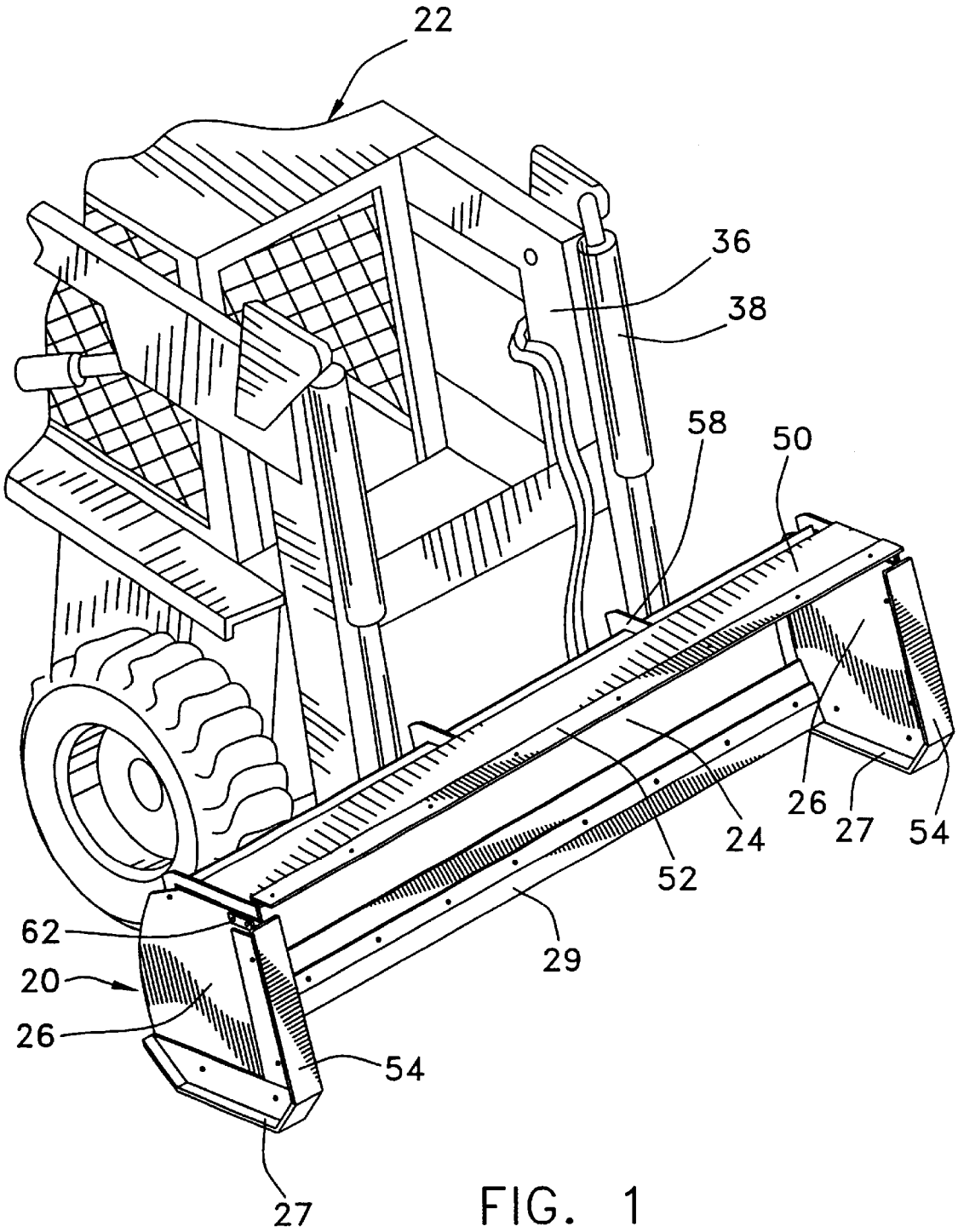
FIG. 1 is a perspective view of a snowplow attachment for a skid steer loader according to first embodiment of the present invention.
Figure 2:
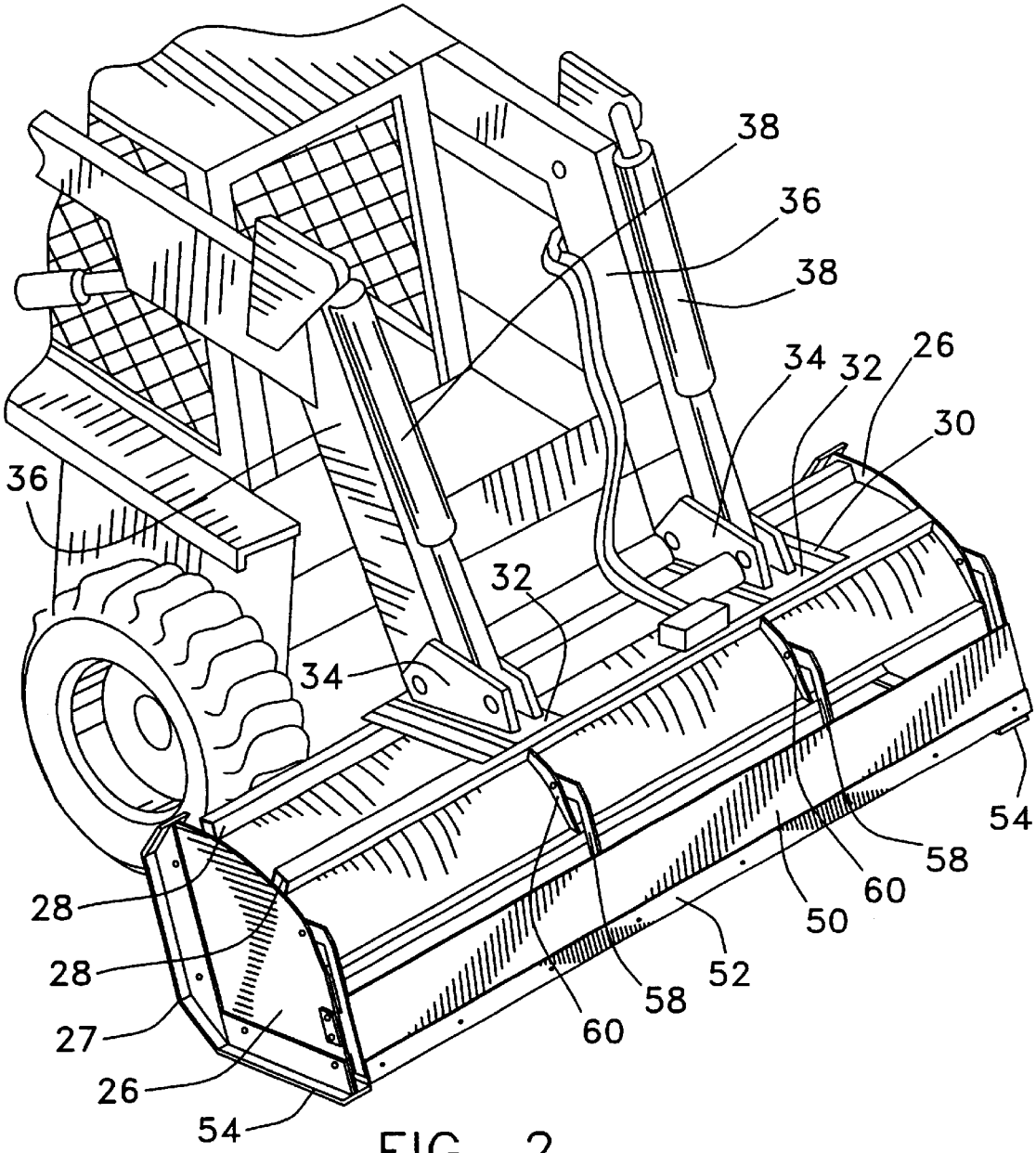
FIG. 2 is a perspective view similar to that shown in FIG. 1 but with the snowplow illustrated in a pivoted position in the pulling mode.

For purposes of illustration, a preferred embodiment of the present invention has been illustrated in FIGS. 1–2 as a snowplow attachment 20 for releasably mounting on a vehicle shown as a skid steer loader 22. It should be understood from the outset that the invention is not limited to use on skid steer loaders and can be used on other vehicles such as trucks, tractors, and the like.

The snowplow attachment 20 includes a vertically upstanding concave push blade 24 extending outside the lateral span of the skid steer 22 and horizontally spaced apart vertically extending side plates 26 on the opposite ends of the push blade 24. The side plates 26 extend forwardly from the push blade 24 such that pushed snow is contained between the side plates and does not escape out the sides. This advantageously increases the volume of snow that can be moved during a sweep of the vehicle driven snowplow. The side plates 26 each include a removable wear or skid shoe 27 that is adapted for sliding contact with the ground. The front and back ends of the skid shoe 27 are angled such that the snowplow attachment 20 rides easily both forwardly and rearwardly over a rough surface. A removable, resilient rubber edge 29 is mounted along the bottom edge of the push blade 24 for engaging or almost engaging and scraping the ground surface to clean the surface of snow while preventing bumps or cracks in the ground surface from catching on the bottom edge of the push blade 24. Both the push blade 24 and the side plates 26 as well as the other structural components of the attachment 20 except where otherwise noted are preferably formed of steel material.

As shown best in FIG. 2, the backside of the blade 24 may include horizontal and vertical reinforcing channels 28, 30 welded to the backside of the blade 24 for structural support and reinforcement. A quick attachment mechanism 32 is mounted on the back side of the blade 24 which allows the snowplow attachment 20 to be quickly attached and detached from the interfitting quick attachment mechanism 34 of the skid steer 22. Such quick attachment mechanisms are well known in the skid steer art and related machinery/tractor art as demonstrated by U.S. Pat. No. 3,794,195 to Clevenger et al. and U.S. Pat. No. 5,098,252 to Sheesley et al., which are hereby incorporated by reference for detailing quick attach mechanisms. Suffice it to say that the quick attach mechanisms 32, 34 can be interlocked or connected to provided sufficient support to vertically elevate the attachment 20, pivot the attachment 20, and mobilize it both horizontally, forwardly, and rearwardly even under the imposition of a heavy load of snow.

In accordance with the present invention, the embodiment of FIG. 1 includes a pull blade 50 that drops down in front of the push blade for pulling back pushed snow. In this embodiment the pull blade 50 is mounted along the top of the push blade 24 in a removable manner such that the pull blade 50 can be removed or replaced if desired. In particular, the pull blade 50 includes rear mounting arms 58 that mount via nuts and bolts directly to ribs 60 on the back side of the push blade 24 and side mounts 62 that mount to the side plates 26 via nuts and bolts for lateral support. When the snowplow attachment 20 is oriented in the push mode, forward movement of the attachment 20 causes the push blade 24 to push the snow. In the push mode, the pull blade 50 extends forwardly and horizontally from the top of the push blade 24 and is sufficiently elevated such that it does not interfere with the typical volume of snow that is being pushed. However, once it is desired to pull snow, the entire snowplow attachment 20 is rotated roughly about 90° via the hydraulic cylinders 38 on the front arms 36 of the skid steer 22. The different positions of the snowplow attachment can be seen with reference to FIGS. 1 and 2, wherein FIG. 1 illustrates the attachment in push mode in which snow is pushed forwardly by the push blade 24 and FIG. 2 illustrates the pull mode in which snow is pulled rearwardly by the pull blade 50.

Importantly, when switching from pushing mode to pulling mode, the pull blade 50 drops down in front of the position of the push blade 24 (specifically the position of the push blade in the push mode). Advantageously, this allows the snow attachment to be positioned up close to permanent structures such as buildings for removal of snow therefrom. This also allows the pull blade to engage and pull back the previously pushed snow via rearward movement of the skid steer 22. Thus, the versatility of the snowplow attachment 20 is greatly increased. The pull blade 50 is also able to engage the pushed snow contained between side plates 26 without the need to move the skid steer loader 22 forward.

It is a further advantage that the side plates 26 are also positioned on the ends of the pull blade 50 such that during pulling mode the pulled snow does not escape out the sides. This also increases the volume of snow that can be pulled back. A second set of removable skid wear shoes 54 may be mounted along the front edge of the side plates 26 that are operable during the pull mode to slide along the ground surface. A removable, resilient rubber edge 52 is also preferably mounted along the bottom edge of the pull blade 50 for scraping the ground surface during pulling mode similar to the operation of the rubber edge of the push blade 24 during pushing mode.

It should be noted that because the skid steer loader 22 inherently has the capabilities to rotate the snowplow attachment 20, that no actuator need be provided on this form of a snowplow attachment 20. However, it will be appreciated that a separate mounting frame pivotably carrying the attachment 20 could be used with a separate actuator or cylinder between the mounting frame and attachment switching it between pushing and pulling modes if the vehicle does not have such means.

Figure 3:
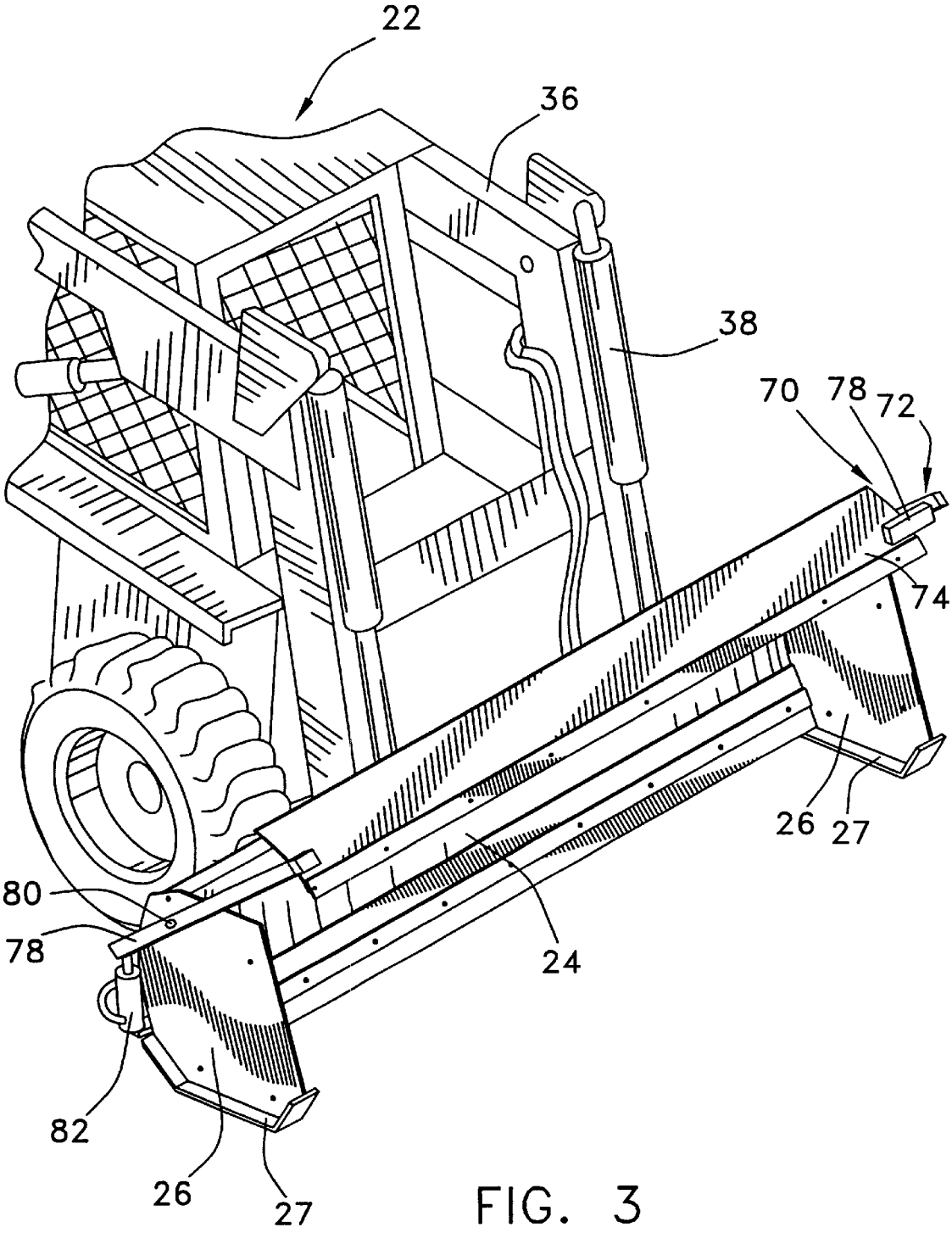
FIG. 3 is a perspective view of a snowplow attachment for a skid steer loader according to second embodiment of the present invention.
Figure 4:
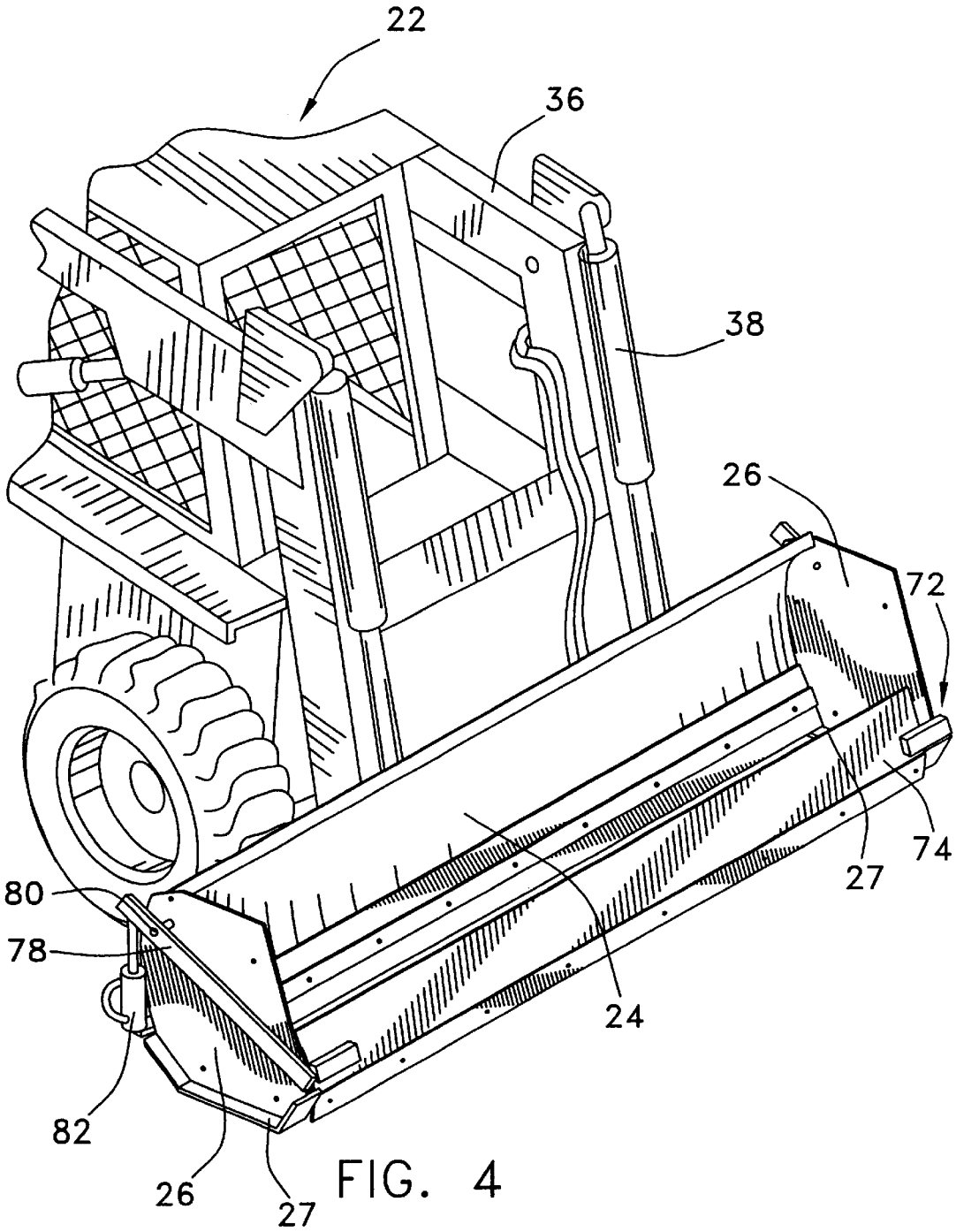
FIG. 4 is a perspective view similar to that shown in FIG. 3 but with the snowplow illustrated in the pulling mode with the pull blade lowered.

Turning to FIGS. 3–4, a second preferred embodiment is illustrated in the form of another snowplow attachment 70 mounted on a similar skid steer loader 22. Similar structures in this embodiment are designated with like reference characters for the purpose of facilitating an easier understanding of this embodiment.

The snowplow attachment 70 of the second embodiment includes a pivotable pull blade assembly 72 that pivots or otherwise moves upwardly and downwardly relative to the push blade 24. The pull blade assembly 72 includes a traverse pull blade 74 mounted between a pair of support arms 78. Each support arm 78 is pivotably mounted to one of the side plates 26 at pivot joint 80. A pair of hydraulic cylinders 82 (or other form of actuator) supported near the side plates 26 are connected to the pull blade assembly 72 for raising and lowering the pull blade 74 to switch between a pushing mode as shown in FIG. 3 and a pulling mode as shown in FIG. 4. It is an advantage of this embodiment that rotation of the entire snowplow attachment 70 is not necessary and as such this attachment can be used readily with other types of vehicles such as certain trucks which do not have the means for readily rotating attachments as do skid steer loaders.

Importantly, the pull blade 74 drops down in front of the push blade 24 in this embodiment thereby ensuring that pushed snow can then be pulled back. The pull blade 74 is preferably positioned proximate the front-most end of the side plates 26 (in contrast to the push blade 24 which is located proximate the rear end of the side plates 26) such that the maximum amount of snow can be pulled back and such that the pull blade can be located very close to permanent structures. The location of the pivot joint 80 is preferably as low and rearward as possible on the side plates 26 such that the swinging movement of the arms does not cause the blade to swing too far outwardly and forwardly from the snow side plates 26 such that it unduly limits how close the attachment can be placed near to the permanent structure or building.

Figure 5:
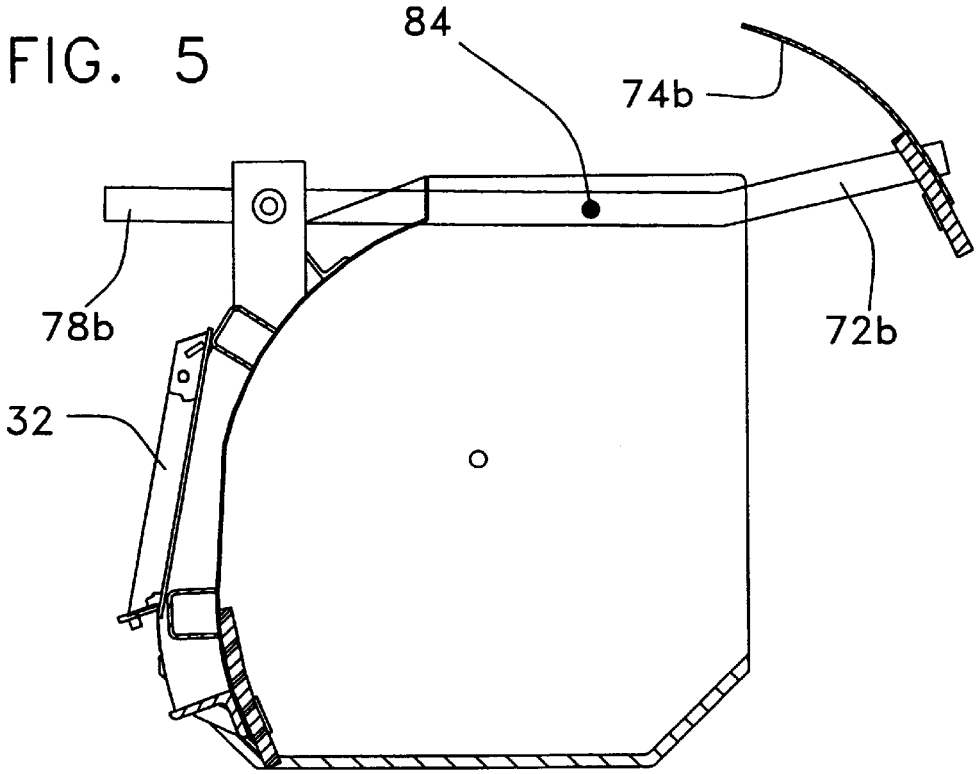
FIGS. 5–6, 7–8 and 9–10 are cross-sectional views about the center snowplow attachments according to three (3) further alternative embodiments of the present invention, respectively.
Figure 6:
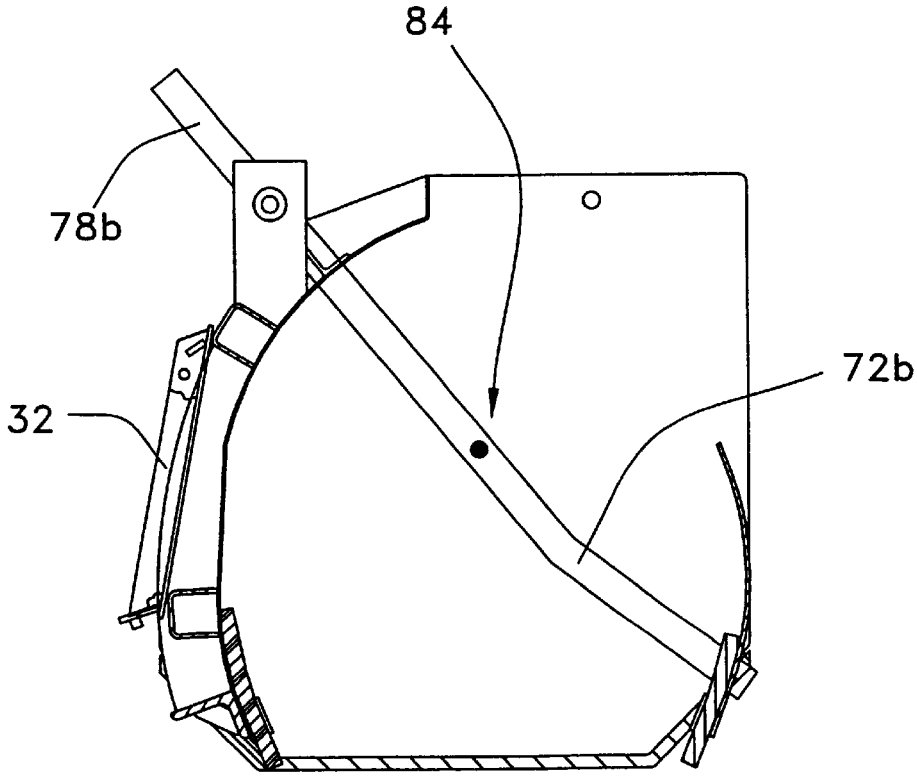

However, higher pivot joint locations can be provided as shown in the further embodiment of FIGS. 5–6. As is also shown in the further alternative embodiment, hydraulic actuation or other power driven movement of the pull blade 74*b* is not an absolute necessity as the pull blade assembly 72*b* may be raised and lowered manually. In the raised position, the pull blade 74*b* may be pinned or retained by a pin and socket mechanism 84 as shown or other form or retainer such as a hook and chain. This provides a cheaper alternative and also an alternative where it is desirable to use a pivoting pull blade or where there is no easily available power source. The arm 78*b* and pin and socket mechanism 84 may also be located near the center of the snowplow rather than on the outside of the side plates such that an operator of the skid steer can easily manually activate the pull blade assembly without having to get completely out of the skid steer. This is particularly advantageous where the pull mode is used relatively infrequently or just on occasion when moving snow.

Figure 7:
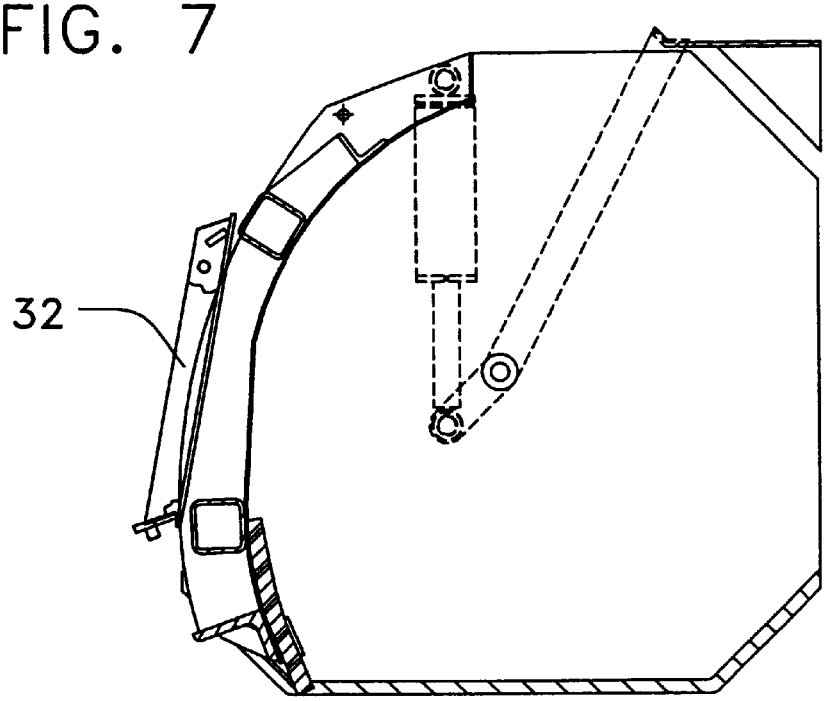
Figure 8:
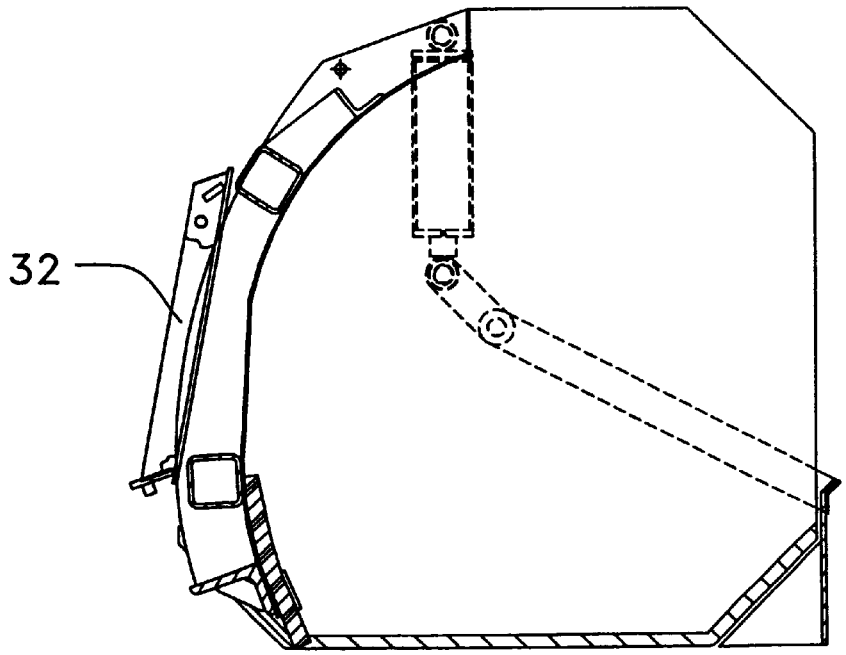
Figure 9:
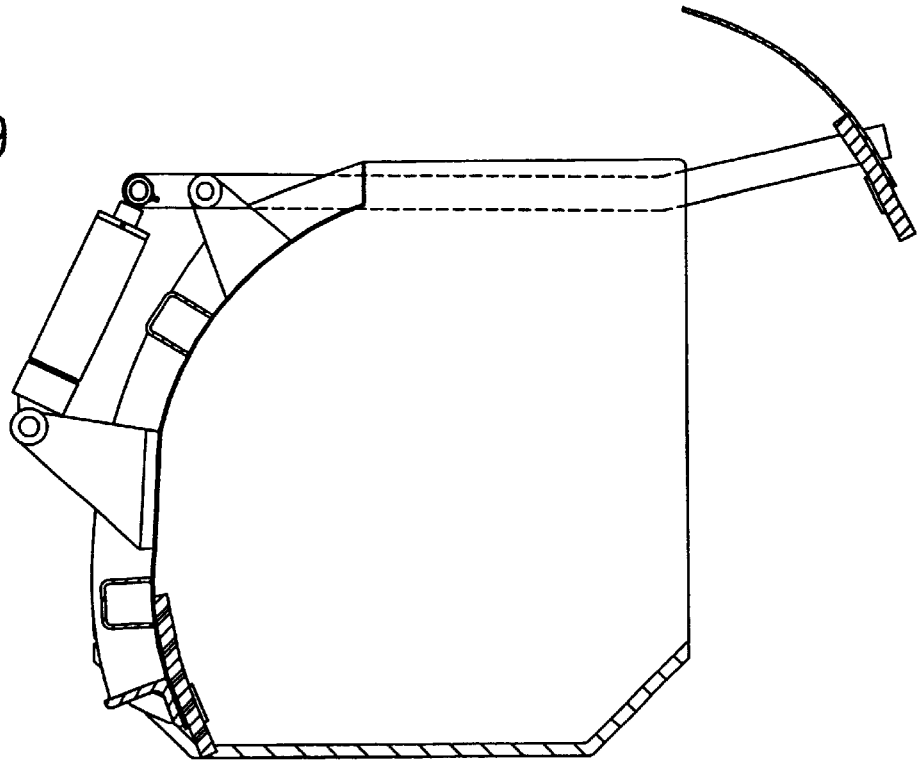
Figure 10:
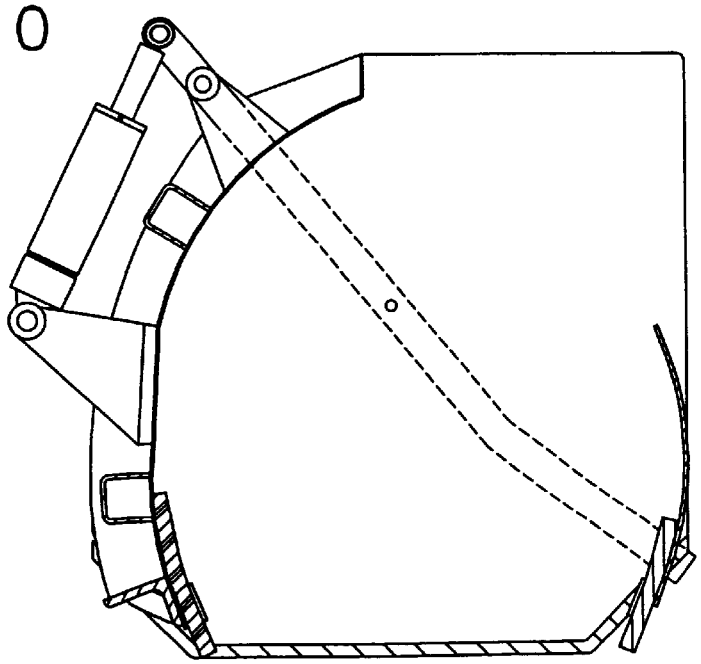

The further two embodiments of FIGS. 7–8 and 9–10, respectively, illustrate further embodiments of the present invention with different arrangements of the pivot point and cylinder. FIGS. 7–8 also illustrate a different shape and form of pull plow that can be used that includes a high strength abrasive resistant mat.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A snowplow apparatus adapted to be mounted on the front of a vehicle, the vehicle adapted to move the snowplow apparatus forwardly and rearwardly to correspondingly push and pull snow during pushing and pulling modes, comprising:

a push blade extending horizontally in front of the vehicle adapted to push snow during the push mode; and a pull blade disposed in front of the push blade and extending horizontally in front of the vehicle, the pull blade having a raised position during the push mode, the pull blade being lowered in front of the push blade during transition from the push mode to the pull mode for pulling snow.

2. The snowplow attachment of claim 1 further comprising an actuator operatively connected to the pull blade wherein the actuator raises and lowers the pull blade.

3. The snowplow attachment of claim 1 wherein the pull blade is pivotable relative to the push blade, mounted between a pair of arms.

4. The snowplow attachment of claim 3 further comprising at least one extendible and retractable actuator operatively connected to the pull blade adapted to raise and lower the pull blade.

5. The snowplow attachment of claim 1 further comprising an attach mechanism on the back side of the push blade adapted to attach to a loader vehicle, and wherein the entire snowplow attachment is adapted to be rotated the via the attach mechanism to switch between pushing and pulling modes, the pull blade extending horizontally forward from a top portion of the push blade while in the push mode.

6. A snowplow attachment for mounting on a vehicle, adapted to be mobilized forwardly and rearwardly for pushing and pulling snow along a ground surface, comprising:

a push blade assembly adapted to mount on the vehicle, including a push blade extending horizontally between vertically extending side plates, the push blade having a lower edge located in close proximity to the ground surface for pushing snow, the side plates extending forwardly from the push blade such that pushed snow is adapted to be contained between the side plates; and a pull blade carried by the push blade assembly movable relative to the push blade assembly between a raised position and a lowered position wherein the pull blade is in close proximity to the ground surface and in front of the push blade for pulling snow.

7. The snowplow attachment of claim 6 further comprising an actuator operatively connected to the pull blade wherein the actuator raises and lowers the pull blade.

8. The snowplow attachment of claim 6 wherein the pull blade is connected transversely between a pair of arms, the arms being pivotably mounted to the side plates such that the pull blade pivots relative to the push blade and in front of the push blade.

9. The snowplow attachment of claim 8 further comprising at least one extendible and retractable actuator mounted to the push blade assembly, operatively connected to the pull blade and adapted to raise and lower the pull blade.

10. The snowplow attachment of claim 8 further comprising a manually operated retainer mechanism adapted to selectively hold the pull blade in the raised position and the lowered position.

11. The snowplow attachment of claim 8 wherein each of the side plates include a pivot joint pivotally supporting one of the arms.

12. The snowplow attachment of claim 6 further comprising:

skid shoes mounted along the bottom edges of the side plates; and resilient rubber wear strips mounted along the respective edges of the pushing and pulling blades adapted to scrape the ground surface.

13. The snowplow attachment of claim 6 wherein the push blade is a steel concave structure.

14. A snowplow attachment for mounting on a vehicle, adapted to be mobilized along a ground surface forwardly in a push mode for pushing snow and rearwardly in a pull mode for pulling snow, comprising:

a pair of vertically extending spaced apart side plates;

a push blade affixed to the side plates, extending transversely between the side plates and in close proximity to the ground during the push mode for pushing snow; and a pull blade extending transversely between the side plates and forwardly from the push blade and proximate the top of the push blade while in the push mode, wherein the entire snowplow attachment is adapted to be rotated to switch between the pushing and pulling modes, the pull blade in close proximity to the ground during the pull mode for pulling snow.

15. The snowplow attachment of claim 14 further comprising an attach mechanism on the back side of the push blade adapted to attach to a loader vehicle, and wherein the entire snowplow attachment is adapted to be rotated by the loader vehicle via the attach mechanism, the pull blade being mounted to the push blade assembly such that the position of the pull blade is fixed relative to the position of the push blade during the rotation.

16. The snowplow attachment of claim 15 further comprising a first set of skid shoes extending along a bottom edge of the side plates and a second set of skid shoes extending vertically along a front edge of the side plates.

17. The snowplow attachment of claim 14 further comprising:

resilient rubber wear strips mounted along the respective edges of the pushing and pulling blades adapted to scrape the ground surface.

18. The snowplow attachment of claim 14 wherein the push blade is a steel concave structure.

19. The snowplow attachment of claim 14 wherein the pull blade is secured to and supported by the side plates, and wherein the pull blade is secured to and supported by the push blade such that the position of the pull blade is fixed relative to the position of the push blade.

20. The snowplow attachment of claim 19 further comprising support arms extending rearwardly from the pull blade fastened to the push blade, and a support structure fastened to the side plates.

21. The snowplow attachment of claim 14 wherein each of the side plates include top and bottom ends and a back end extending vertically between the top and bottom ends, the push blade extending traversely generally between the back ends of the side plates, the pull blade extending traversely generally between the top ends of the side plates.

22. The snowplow attachment of claim 14 wherein the pull blade is removably fastened to the side plates and the push blade.

23. The snowplow attachment of claim 14 wherein rotation of the snowplow attachment of about 90° simultaneously rotates the push and pull blades in unison between the pushing and pulling modes.

24. A snowplow apparatus for mounting on a vehicle, adapted to be mobilized along a ground surface forwardly in a push mode for pushing snow and rearwardly in a pull mode for pulling snow, comprising:

a pair of spaced apart vertically extending side plates;

a push blade in close proximity to the ground surface during the push mode for pushing snow, the push blade disposed horizontally between the side plates proximate a rearward portion of the side plates during the push mode such that pushed snow is adapted to be contained between the side plates; and a movable pull blade having raised and lowered positions relative to the push blade, the pull blade in close proximity to the ground surface during the pull mode for pulling snow and being raised relative thereto in the push mode, the pull blade disposed horizontally between the side plates proximate a forward portion of the side plates during the pull mode such that pulled snow is adapted to be contained between the side plates.

25. The snowplow attachment of claim 24 further comprising an actuator operatively connected to the pull blade wherein the actuator raises and lowers the pull blade.

26. The snowplow attachment of claim 24 wherein the pull blade is connected transversely between a pair of arms, the arms being pivotably mounted to the side plates such that the pull blade pivots relative to the push blade and in front of the push blade.

27. The snowplow attachment of claim 26 further comprising at least one extendible and retractable actuator mounted to the push blade assembly, operatively connected to the pull blade and adapted to raise and lower the pull blade.

28. The snowplow attachment of claim 26 further comprising a manually operated retainer mechanism adapted to selectively hold the pull blade in the raised position and the lowered position.

29. The snowplow attachment of claim 26 wherein each of the side plates include a pivot joint pivotally supporting one of the arms.

30. The snowplow attachment of claim 24 further comprising:

resilient rubber wear strips mounted along the respective edges of the pushing and pulling blades adapted to scrape the ground surface.

31. The snowplow attachment of claim 24 wherein the push blade and the pull blade are steel concave structures.

32. The snowplow attachment of claim 24 further comprising an attach mechanism on the back side of the push blade adapted to attach to a loader vehicle.

* * * * *